US010390596B2

(12) United States Patent
Feng

(10) Patent No.: US 10,390,596 B2
(45) Date of Patent: Aug. 27, 2019

(54) ALUMINUM PLATE-COATED MULTIFUNCTIONAL HAIR STRAIGHTENER

(71) Applicant: Shenzhen Lady Merry Technology Co., Ltd., Shenzhen (CN)

(72) Inventor: Ye Feng, Shenzhen (CN)

(73) Assignee: SHENZHEN LADY MERRY TECHNOLOGY CO., LTD, Shenzhen (CN)

( * ) Notice: Subject to any disclaimer, the term of this patent is extended or adjusted under 35 U.S.C. 154(b) by 441 days.

(21) Appl. No.: 15/263,053

(22) Filed: Sep. 12, 2016

(65) Prior Publication Data

US 2018/0070695 A1 Mar. 15, 2018

(51) Int. Cl.

| | |
|---|---|
| ***A45D 2/00*** | (2006.01) |
| ***A45D 1/02*** | (2006.01) |
| ***A45D 1/08*** | (2006.01) |

(52) U.S. Cl.

CPC ..... *A45D 2/001* (2013.01); *A45D 1/02* (2013.01); *A45D 1/08* (2013.01)

(58) Field of Classification Search

CPC ..... A45D 7/00; A45D 6/00; A45D 2200/202; A45D 20/48; A45D 2/002; A45D 2/001

USPC ..... 132/224

See application file for complete search history.

(56) References Cited

U.S. PATENT DOCUMENTS

| | | | | |
|---|---|---|---|---|
| 8,124,914 | B2 * | 2/2012 | Yu | A45D 1/04 132/224 |
| 2002/0036000 | A1 * | 3/2002 | Hirata | A45D 1/00 132/224 |
| 2008/0041408 | A1 * | 2/2008 | Shepherd | A45D 1/04 132/224 |
| 2016/0360846 | A1 * | 12/2016 | Shami | A45D 1/04 |
| 2017/0311690 | A1 * | 11/2017 | Feng | A45D 6/20 |
| 2018/0064226 | A1 * | 3/2018 | Richmond | A45D 1/06 |

* cited by examiner

*Primary Examiner* — Tatiana L Nobrega
*Assistant Examiner* — Jennifer F Gill
(74) *Attorney, Agent, or Firm* — Schmeiser, Olsen & Watts LLP

(57) ABSTRACT

Disclosed is fabric taped aluminum plates multifunctional hair straightener, relating to hairdressing apparatus field. Lower battens are clamped on two sides of lower aluminum plate with lower fabric on surface and lower aluminum plate stopper at one end, lower cover plate and lower cover plate stopper fixedly connected with other side of lower body via several first screws are installed on other side of lower body, one end of the lower cover plate is clamped with that of the lower cover plate stopper; upper clamping spring, upper elastic sheet, upper silicone pad, FUSE, second MCH, second manganese steel sheet and upper aluminum plate are installed inside one side of upper body; upper battens are clamped on two sides of the upper aluminum plate with upper fabric on surface. The hairdressing apparatus having fabric-coated aluminum plates keeps users' hair softer, and is antistatic and silk-like, thereby avoiding water vaporization.

3 Claims, 5 Drawing Sheets

ALUMINUM PLATE-COATED MULTIFUNCTIONAL HAIR STRAIGHTENER

FIELD OF THE INVENTION

The present invention relates to a fabric taped aluminum plates multifunctional hair straightener, belonging to the technical field of hairdressing apparatuses.

BACKGROUND OF THE INVENTION

Nowadays, beauty becomes a pursuit, beautiful hair can better show personal beauty, then hairdressing apparatuses are indispensable, which generally include hair straighteners and hair curlers, wherein the hair straightener is also named as an electric clamping plate or a clamping plate informally and used for straightening hair as its name implies, and fulfills the purpose of straightening hair by heating a metal ceramics heater (MCH) or a positive temperature coefficient thermistor (PTC) or a heating wire thereof with current and conducting heat to aluminum plates or ceramic plates to emit heat.

At present, the aluminum plate surfaces of the existing hair straighteners mostly adopt an oil injection or electroplating process. However, when the two processes are used, hair cannot be well protected to be softer, hair is easy to clamp, and water on the surface is easy to vaporize when wet hair is straightened, so that the use requirements of people cannot be met.

SUMMARY OF THE INVENTION

Aiming at the above problems, the technical problem to be solved by the present invention is to provide a fabric taped aluminum plates multifunctional hair straightener.

The fabric taped aluminum plates multifunctional hair straightener of the present invention includes a lower body, an upper body, a spring, a shaft sleeve, a shaft sleeve screw, a side cover, a lower clamping spring, a lower elastic sheet, a lower silicon pad, a first MCH (metal ceramic heater), a first manganese steel sheet, a lower aluminum plate, lower battens, a lower fabric, a lower aluminum plate stopper, a lower cover plate, a lower cover plate stopper, first screws, an upper clamping spring, an upper elastic sheet, an upper silicon pad, a FUSE, a second MCH, a second manganese steel sheet, an upper aluminum plate, upper battens, an upper fabric, an upper aluminum plate stopper, a PCBA (Printed Circuit Board Assembly) plate, a sealing pad, an upper cover plate, an upper cover plate stopper, second screws, a pressing line cover, third screws, a turning tail and a female seat.

The spring is arranged between the lower body and the upper body, and the side cover is arranged outside the lower body and the upper body. The lower clamping spring, the lower elastic sheet, the lower silicon pad, the first MCH, the first manganese steel sheet and the lower aluminum plate are arranged inside one side of the lower body. A lower batten is clamped on each of two sides of the lower aluminum plate, the lower fabric is arranged on the surface of the lower aluminum plate, and the lower aluminum plate stopper is installed at one end of the lower aluminum plate. The lower cover plate and the lower cover plate stopper are installed on the other side of the lower body. The upper clamping spring, the upper elastic sheet, the upper silicon pad, the FUSE, the second MCH, the second manganese steel sheet and the upper aluminum plate are arranged inside one side of the upper body. An upper batten is clamped on each of two sides of the upper aluminum plate, the upper fabric is arranged on the surface of the upper aluminum plate, and the upper aluminum plate stopper is installed at one end of the upper aluminum plate. The PCBA plate and the sealing pad are installed inside the other side of the upper body, with the upper cover plate and the upper cover plate stopper are installed on the upper surface of the PCBA plate and the sealing pad.

The fabric taped aluminum plates multifunctional hair straightener has the advantages that the hair straightener is reasonable in structural design, simple in installation and convenient to use; each aluminum plate of the hairdressing apparatus is coated with a fabric, which can lock moisture and prevent moisture loss, so that users feel hair softer when the hair straightener is in use; and the hair straightener has an antistatic function, its surface is as smooth as silk, and water on the coated surface is unlikely to vaporize when wet hair is straightened, so that the use requirements of people are met.

BRIEF DESCRIPTION OF THE DRAWINGS

In order to facilitate illustration, the present invention will be described in detail in combination with the following specific embodiment and accompanying drawings.

1—lower body; 2—upper body; 2-1—panel; 2-2—key; 3—spring; 4—shaft sleeve; 5—shaft sleeve screw; 6—side cover; 7—lower clamping spring; 8—lower elastic sheet; 9—lower silicon pad; 10—first MCH; 11—first manganese steel sheet; 12—lower aluminum plate; 13—lower batten; 14—lower fabric; 15—lower aluminum plate stopper; 16—lower cover plate; 17—lower cover plate stopper; 18—first screw; 19—upper clamping spring; 20—upper elastic sheet; 21—upper silicon pad; 22—FUSE; 23—second MCH; 24—second manganese steel sheet; 25—upper aluminum plate; 26—upper batten; 27—upper fabric; 28—upper aluminum plate stopper; 29—PCBA plate; 30—sealing pad; 31—upper cover plate; 32—upper cover plate stopper; 33—second screw; 34—pressing line cover; 35—third screw; 36—turning tail; 37—female seat.

DETAILED DESCRIPTION OF THE EMBODIMENTS

Figure 1:
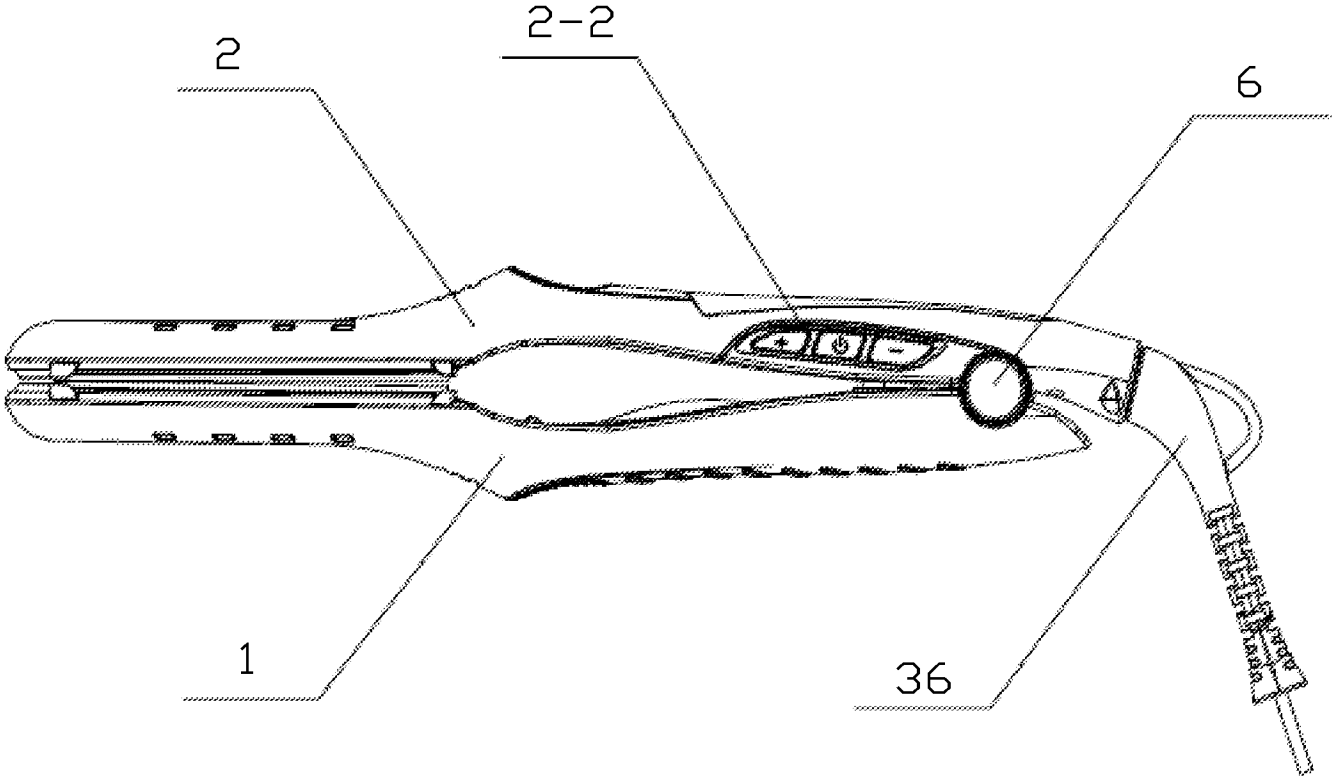
FIG. 1 is a side view of a fabric taped aluminum plates multifunctional hair straightener according to the present invention.
Figure 2:
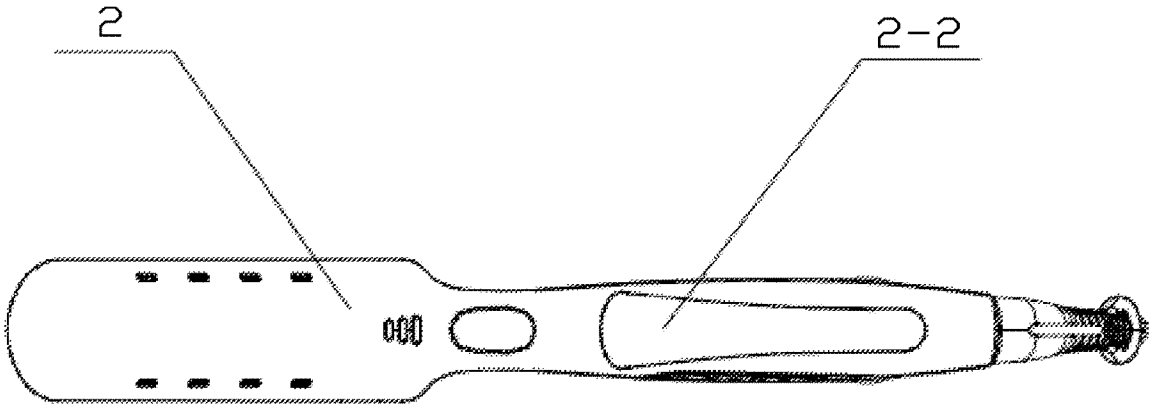
FIG. 2 is a top view of FIG. 1.
Figure 3:
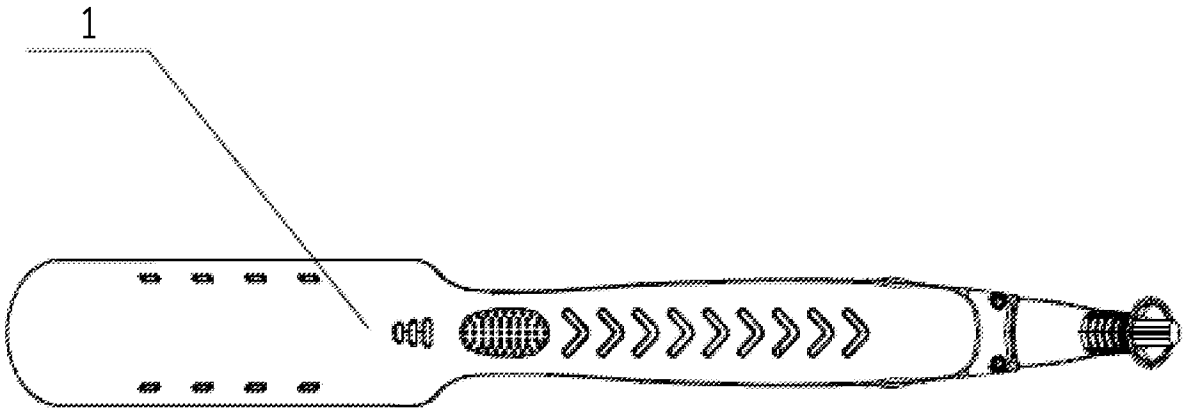
FIG. 3 is a bottom view of FIG. 1.
Figure 4:
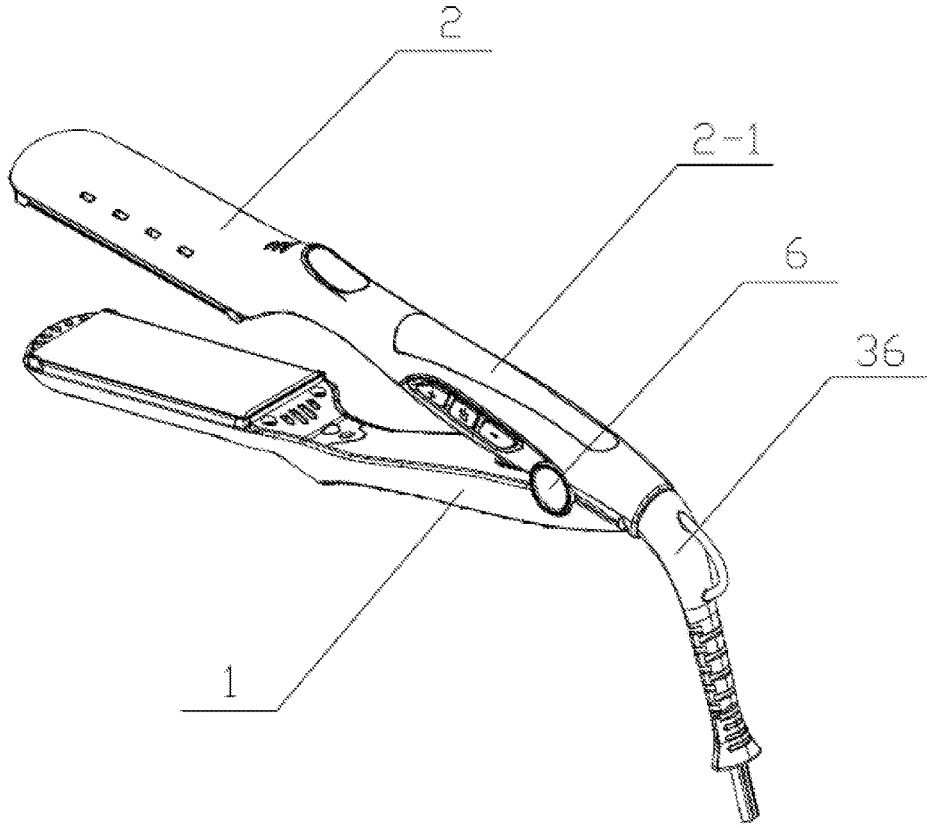
FIG. 4 is a perspective view of the fabric taped aluminum plates multifunctional hair straightener of FIF. 1.
Figure 5:
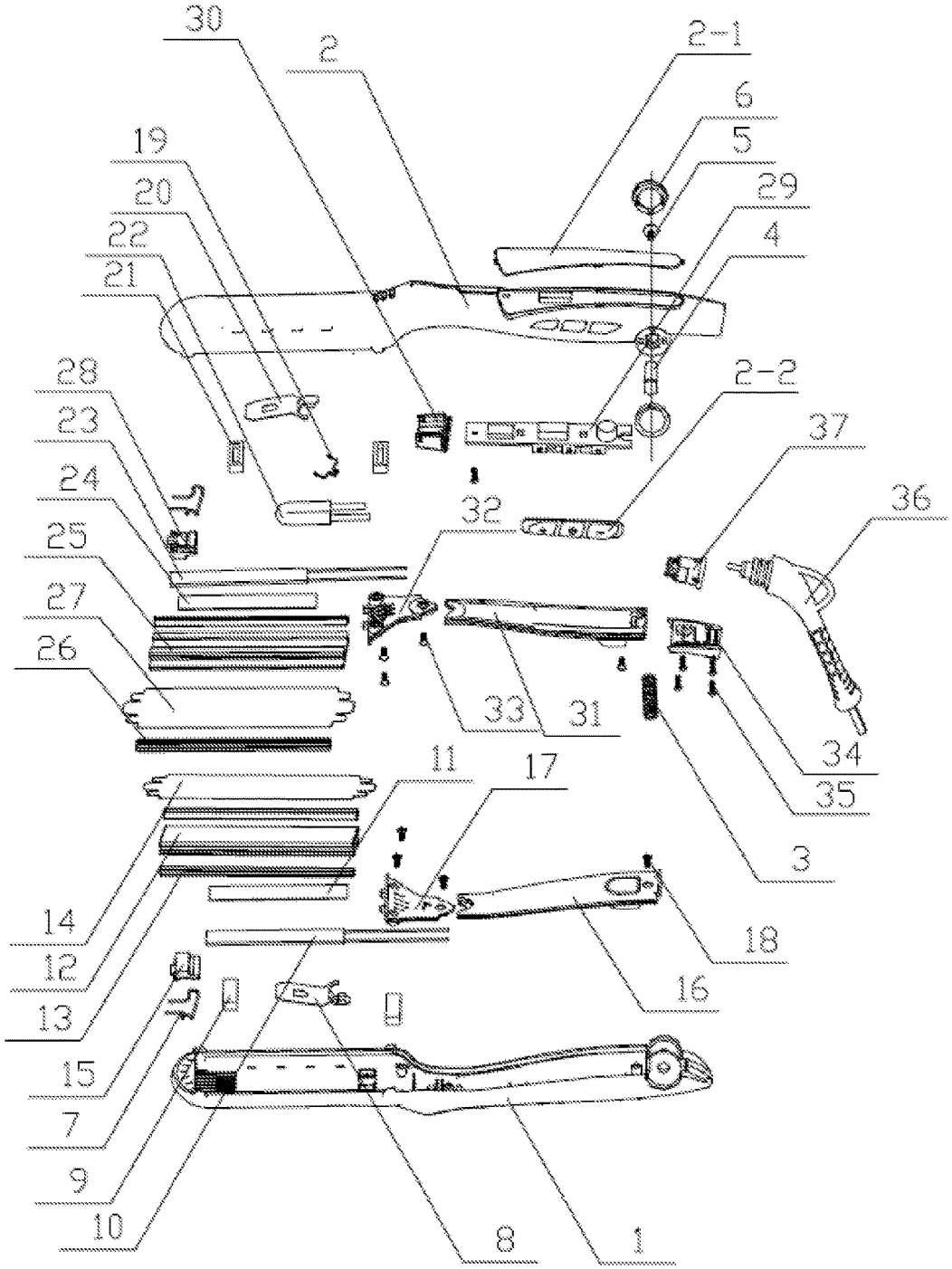
FIG. 5 is an ecploded view of the fabric taped aluminum plates multifunctional hair straightener of FIG. 1.

As shown in FIG. 1 to FIG. 5, this specific embodiment adopts the following technical solution. A fabric taped aluminum plates multifunctional hair straightener includes a lower body 1, an upper body 2, a spring 3, a shaft sleeve 4, a shaft sleeve screw 5, a side cover 6, a lower clamping spring 7, a lower elastic sheet 8, and a lower silicon pad 9. The fabric taped aluminum plates multifunctional hair straightener also includes a first MCH 10, a first manganese steel sheet 11, a lower aluminum plate 12, lower battens 13, a lower fabric 14, a lower aluminum plate stopper 15, a lower cover plate 16, a lower cover plate stopper 17, first screws 18, and an upper clamping spring 19. The Fabric taped aluminum plates multifunctional hair straightener also includes an upper elastic sheet 20, an upper silicon pad 21, a FUSE 22, a second MCH 23, a second manganese steel sheet 24, an upper aluminum plate 25, upper battens 26, an upper fabric 27, an upper aluminum plate stopper 28, and a PCBA plate 29. Further, the fabric taped aluminum plates multifunctional hair straightener includes a sealing pad 30, an upper cover plate 31, an upper cover plate stopper 32, second screws 33, a pressing line cover 34, third screws 35, a turning tail 36 and a female seat 37.

The spring 3 is arranged between the lower body 1 and the upper body 2 which are fixedly connected via the shaft sleeve 4 and the shaft sleeve screw 5. The side cover 6 is arranged outside the lower body and the upper body. The lower clamping spring 7, the lower elastic sheet 8, the lower silicon pad 9, the first MCH 10, the first manganese steel sheet 11 and the lower aluminum plate 12 are arranged inside one side of the lower body 1. The lower batten 13 is clamped on each of two sides of the lower aluminum plate 12. The lower fabric 14 is arranged on the surface of the lower aluminum plate 12, and the lower aluminum plate stopper 15 is installed at one end of the lower aluminum plate 12. The lower cover plate 16 and the lower cover plate stopper 17 are installed on the other side of the lower body 1, one end of the lower cover plate 16 is clamped with one end of the lower cover plate stopper 17, and the lower cover plate 16 and the lower cover plate stopper 17 are fixedly connected with the other side of the lower body 1 via a plurality of first screws 18.

The upper clamping spring 19, the upper elastic sheet 20, the upper silicon pad 21, the FUSE 22, the second MCH 23, the second manganese steel sheet 24 and the upper aluminum plate 25 are arranged inside one side of the upper body 2. The upper batten 26 is clamped on each of two sides of the upper aluminum plate 25. The upper fabric 27 is arranged on the surface of the upper aluminum plate 25, and the upper aluminum plate stopper 28 is installed at one end of the upper aluminum plate 25.

The PCBA plate 29 and the sealing pad 30 are installed inside the other side of the upper body 2. The upper cover plate 31 and the upper cover plate stopper 32 are installed on the upper surface of the PCBA plate and the sealing pad. One end of the upper cover plate 31 is clamped with one end of the upper cover plate stopper 32, and the upper cover plate 31 and the upper cover plate stopper 32 are fixedly connected with the other side of the upper body 2 via a plurality of second screws 33. The pressing line cover 34 is arranged below one end of the upper body 2 and is fixedly connected with the other end of the upper body 2 via a plurality of third screws 35. One end of the turning tail 36 is fixedly connected with one end of the upper body 2 via the female seat 37.

A panel 2-1 is arranged on the upper surface of the upper body 2, and keys 2-2 are arranged on one side of the upper body 2. Both of the lower fabric 14 and the upper fabric 27 are made of a mixture of silicon gel and polytetrafluoroethylene.

In the specific embodiment, after the straightener is powered on, heat emitted by the first MCH 10 and the second MCH 23 is conducted to the lower aluminum plate 12 coated with the lower fabric 14 and the upper aluminum plate 25 coated with the upper fabric 27, so that the temperature of the product quickly rises to reach the temperature for straightening hair.

The fabric taped aluminum plates multifunctional hair straightener in the specific embodiment has the advantages that the hair straightener is reasonable in structural design, simple in installation and convenient to use; each aluminum plate of the hairdressing apparatus is coated with a fabric, which can lock moisture and prevent moisture loss, so that users feel hair softer when the straightener hair is in use; and the hair straightener has an antistatic function, its surface is as smooth as silk, and water on the coated surface is unlikely to vaporize when wet hair is straightened, so that the use requirements of users are met.

The basic principle, main features and advantages of the present invention are shown and described above. Those skilled in the art should understand that the present invention is not limited to the above embodiment, what described in the above embodiment and the specification only illustrates the principle of the present invention, various changes and improvements may be made to the present invention without departing from the spirit and scope of the present invention, and these changes and improvements fall into the scope of the present invention. The protection scope of the present invention is defined by the appended claims and equivalents thereof.

The invention claimed is:

1. A hair straightener comprising a lower body (1), an upper body (2), a spring (3), a shaft sleeve (4), a shaft sleeve screw (5), a side cover (6), a lower clamping spring (7), a lower elastic sheet (8), a lower silicon pad (9), a first metal ceramic heater (10), a first manganese steel sheet (11), a lower aluminum plate (12), lower battens (13), a lower fabric (14), a lower aluminum plate stopper (15), a lower cover plate (16), a lower cover plate stopper (17), first screws (18), an upper clamping spring (19), an upper elastic sheet (20), an upper silicon pad (21), a fuse (22), a second metal ceramic heater (23), a second manganese steel sheet (24), an upper aluminum plate (25), upper battens (26), an upper fabric (27), an upper aluminum plate stopper (28), a printed circuit board assembly plate (29), a sealing pad (30), an upper cover plate (31), an upper cover plate stopper (32), second screws (33), a pressing line cover (34), third screws (35), a turning tail (36) and a female seat (37), wherein the spring (3) is arranged between the lower body (1) and the upper body (2) which are fixedly connected via the shaft sleeve (4) and the shaft sleeve screw (5), and the side cover (6) is arranged outside the lower body and the upper body covering the shaft sleeve and shaft sleeve screw; the lower clamping spring (7), the lower elastic sheet (8), the lower silicon pad (9), the first metal ceramic heater (10), the first manganese steel sheet (11) and the lower aluminum plate (12) are arranged inside a distal end of the lower body (1); a lower batten (13) is clamped on each of two sides of the lower aluminum plate (12), the lower fabric (14) is arranged on a surface of the lower aluminum plate (12), and the lower aluminum plate stopper (15) is installed at one end of the lower aluminum plate (12); the lower cover plate (16) and the lower cover plate stopper (17) are installed near a proximal end of the lower body (1), one end of the lower cover plate (16) is clamped with one end of the lower cover plate stopper (17), and the lower cover plate (16) and the lower cover plate stopper (17) are fixedly connected with the proximal end of the lower body (1) via a plurality of the first screw (18); the upper clamping spring (19), the upper elastic sheet (20), the upper silicon pad (21), the fuse (22), the second metal ceramic heater (23), the second manganese steel sheet (24) and the upper aluminum plate (25) are arranged inside a distal end of the upper body (2); an upper batten (26) is clamped on each of two sides of the upper aluminum plate (25), the upper fabric (27) is arranged on a surface of the upper aluminum plate (25), and the upper aluminum plate stopper (28) is installed at one end of the upper aluminum plate (25); the printed circuit board assembly plate (29) and the sealing pad (30) are installed inside a proximal end of the upper body (2), the upper cover plate (31) and the upper cover plate stopper (32) are installed on an upper surface of the printed circuit board assembly plate and the sealing pad (30), one end of the upper cover plate (31) is clamped with one end of the upper cover plate stopper (32), and the upper cover plate (31) and the upper cover plate stopper (32) are fixedly connected with the proximal end of the upper body (2) via a plurality of the second screws (33); the pressing line cover (34) is arranged at the proximal end of the upper body (2), and is fixedly connected with the proximal end of the upper body (2) via a plurality of third screws (35); and one end of the turning tail (36) is fixedly connected with the proximal end of the upper body (2) via the female seat (37).

2. The hair straightener of claim 1, wherein a panel (2-1) is arranged on the upper surface of the upper body (2) for controlling the first and second metal ceramic heaters, and keys (2-2) are arranged on one side of the upper body (2).

3. The hair straightener of claim 1, wherein both of the lower fabric (14) and the upper fabric (27) are made of a mixture of silicon gel and polytetrafluoroethylene.

* * * * *